US006041842A

United States Patent [19]

Bigot

[11] Patent Number: 6,041,842

[45] Date of Patent: Mar. 28, 2000

[54] WIRING HARNESS WRAPPING

[75] Inventor: Henri Bigot, Creteil, France

[73] Assignee: Coroplast Fritz Muller GmbH & Co. KG, Germany

[21] Appl. No.: 09/117,083

[22] PCT Filed: Jan. 17, 1997

[86] PCT No.: PCT/FR97/00075

§ 371 Date: Sep. 14, 1998

§ 102(e) Date: Sep. 14, 1998

[87] PCT Pub. No.: WO97/26664

PCT Pub. Date: Jul. 24, 1997

[30] Foreign Application Priority Data

Jan. 18, 1996 [FR] France ..... 96 00529

[51] Int. Cl.[7] ..... H01B 13/00

[52] U.S. Cl. ..... 156/466; 156/577; 156/579

[58] Field of Search ..... 156/70, 443, 459, 156/461, 465, 466, 577, 579

[56] References Cited

U.S. PATENT DOCUMENTS 4,750,968 6/1988 Sweeny ..... 156/523
5,425,826 6/1995 Sayyadi et al. ..... 156/73.1
5,628,867 5/1997 Renaud ..... 156/574
5,897,721 4/1999 Kriodske et al. ..... 156/70

FOREIGN PATENT DOCUMENTS 1011026 6/1957 Germany .
2802138 7/1979 Germany .
1098943 1/1968 United Kingdom .

*Primary Examiner*—James Sells
*Attorney, Agent, or Firm*—Jones & Askew, LLP

[57] ABSTRACT

The invention concerns a tool for sheathing a bundle (1) of wires (2) by enveloping this bundle in a flexible adhesive ribbon (3) which is transversely wound about itself around the bundle (1) and whose longitudinal edges (5) are joined by gluing. It comprises a frame (60) equipped with an enveloping head (65) comprising a shaping device (68) for the ribbon (3) which is mounted in a fixed manner on the frame (60) and which possess a return edge (70) in the shape of a V arranged so as to start a longitudinal folding of the ribbon (3), and at least one first pair of clamping jaws (72) mounted on the frame (60) which are movable between an open position and a closed position in which they are applied against each other by means of return means to ensure the gluing of the longitudinal edges (5) of the ribbon (3) against each other and they define between themselves a passage orifice (79) for the sheathed bundle (1).

11 Claims, 7 Drawing Sheets

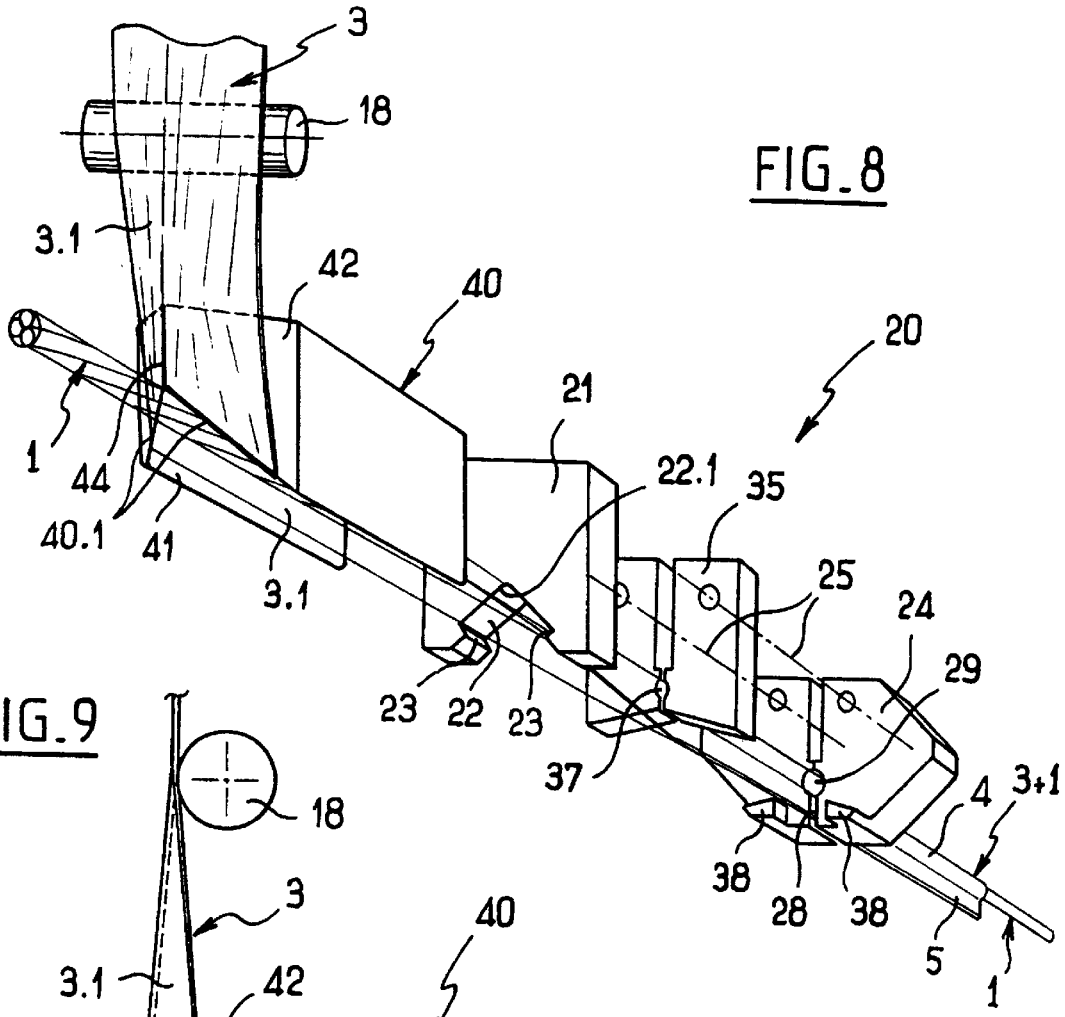
FIG. 8
FIG. 9
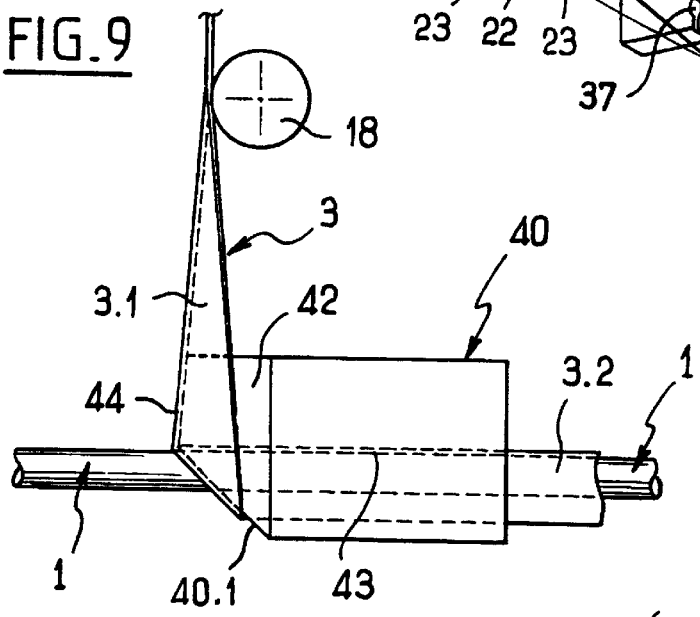
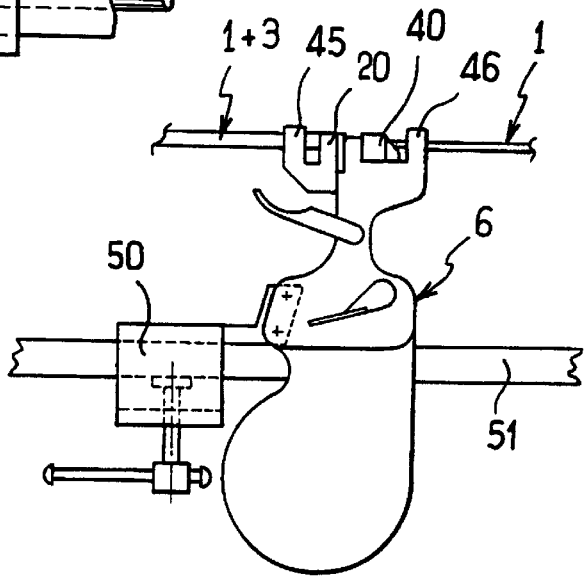
FIG. 13

WIRING HARNESS WRAPPING

The present invention concerns a tool for sheathing a bundle of wires of the electrical cable or tubing type, particularly of the type used in the manufacture of automobiles.

In the automobile sector, the electrical cabling generally consists in preparing one or more bundles of wire on an assembly device, in gathering the wires by means of adhesive connections or split rings made of plastic material, and in covering the combination with a ringed sheath made of split plastic material or a ribbon cover consisting of an adhesive strip.

This sheathing or ribbon covering which is generally called sheathing, has the essential function of imparting to the bundle a certain cohesion so that it can be easily installed on a structural element of a vehicle. In addition, it forms a flexible coating which absorbs vibrations, and dampens shocks between the bundle and the structural element, to avoid noise generation.

The sheathing of wires with small and moderate diameter, such as those intended for automobiles, is usually achieved by a helicoidal ribbon covering, which is applied manually by means of a flexible adhesive strip made of PVC, for example. This operation is particularly time-consuming and the quality of the results are uncertain.

Another sheathing method consists in enveloping the bundle in a ribbon by rolling this ribbon transversely with respect to itself around the bundle and by joining the two lateral edges of this ribbon. The ribbons that are currently used consist of polyurethane foam or adhesive baize, and they are thicker than those used for the helicoidal winding of bundles with small diameters. However, the implementation of this method is particularly difficult when performed manually.

The objective of the invention is to design a tool for sheathing a bundle of wires by means of a ribbon which is wound transversely with respect to itself around the bundle.

For this purpose, according to the invention, a tool for sheathing a bundle of wires is provided by enveloping this bundle in a flexible adhesive ribbon which is wound transversely with respect to itself around the bundle and whose longitudinal edges are joined by gluing, comprising a frame equipped with an enveloping head comprising a device for the shaping of the ribbon, which is mounted in a fixed manner to the frame and which possesses a folding edge that is V-shaped arranged to start a longitudinal folding of the ribbon, and at least a first pair of clamping jaws mounted on the frame which are mobile between an open position and a closed position in which they are applied one against the other by return means to ensure the gluing of the longitudinal edges of the ribbon one against the other and they define between themselves a passage orifice for the sheathed bundle.

Thus, the shaping device starts the transverse winding of the ribbon around the bundle, which is placed in the bottom of the V-shaped profiled part formed by the ribbon on this device. The V shape of the edge of the shaping device makes it possible to cause the different longitudinal strands of the ribbon to move along a trajectory of the same length to avoid an elongation of the end lateral strands which would risk breaking, during the later retraction of these strands, folding operations and local detachments of the ribbon. Indeed, it is understandable that the bundle and the ribbon, before being combined, extend along different directions, so that it is necessary to modify the angle of incidence of at least one of them. As the bundle is generally mounted in an immobile manner on an assembly table, it is easier to modify the direction of incidence of the ribbon by imposing a change in direction (on the order of 90°) at the place where it meets with the bundle. It is precisely this change in direction which is ensured without damage to the ribbon by the V-shaped edge of the shaping device. In addition, the bundle which advances in the bottom of the V formed by this device is thus appropriately applied and glued at the central part of the ribbon which corresponds to the bottom of the V-shaped profiled part formed by this ribbon.

Downstream from the shaping device, the first pair of clamping jaws ensures the folding of the longitudinal edges of the ribbon so as to glue these edges one to the other by their adhesive faces. The bundle and the part of the ribbon which surrounds it are engaged in the orifice, the passageway of which is delimited by these clamping jaws. Thus, it is understandable that the joint advance of the bundle and of the ribbon in the direction from the shaping device toward the first pair of clamping jaws causes the progressive enveloping of the bundle over its length. In this manner a rapid and reliable sheathing of the bundle is achieved. The tool according to the invention thus makes it possible to use in a rapid and reliable manner the sheathing method for transverse winding, not only for bundles with moderate and large diameters, but also for those with small diameters.

According to a first advantageous characteristic of the invention, the enveloping head comprises a second pair of clamping jaws mounted on the frame between the first pair of clamping jaws and the shaping device which are movable between an open position and a closed position towards which they are drawn back by a return means and in which they define between themselves a prewinding die for the ribbon around the bundle. The central part of the ribbon is thus correctly wound around the bundle which is itself correctly wedged in the bottom of the V-shaped profiled part formed by the ribbon. In this manner a clearance between the ribbon and the bundle is avoided, which would risk reducing the quality and harming the appearance of the sheathing produced. The longitudinal edges of the ribbon are bent toward each other, which facilitates the following operation of gluing of these edges, which is carried out by the first pair of clamping jaws. In addition, since the ribbon is adhesive, its central part, which is wound and applied around the bundle, is thus glued to it.

According to a second advantageous characteristic of the invention, the sheathing tool comprises at least one guide for the alignment of the bundle, arranged on the frame upstream from the enveloping head, for the purpose of aligning the bundle with the passage orifice of the first pair of clamping jaws and the tip of the V-shaped edge of the shaping device. The bundle is thus correctly aligned with the bottom of the V-shaped profiled part formed by the ribbon. Advantageously, the sheathing tool comprises a second alignment guide for the bundle, arranged downstream from the enveloping head. In an advantageous embodiment, the two guides for the alignment of the bundle consist of two pulleys arranged on both sides of the enveloping head.

Advantageously, the sheathing tool comprises an additional guide, located upstream from the enveloping head, on one side of the bundle opposite the corresponding alignment guide, this additional guide consisting of two parts mounted on the frame so they are mobile with respect to each other, between a closed position in which they are in contact, and an open position in which they are separated from each other to allow the passage of the bundle.

According to a third advantageous characteristic of the invention, the V-shaped surface of the shaping device possesses two end edges which are turned towards each other so as to form support catches for the longitudinal edges of the ribbon.

Other characteristics and advantages will become apparent in a reading of the following description of one of its embodiments.

Reference will be made to the drawings in the appendix in which:

FIG. 8 is a partial perspective view which schematically illustrates the functions of the different constituent devices of the enveloping head, which ensures the positioning of the ribbon around the bundle of wires;

FIG. 9 is a partial profile view of the area where the ribbon and the bundle of wires meet, illustrating the function of the return device;

Figure 6:
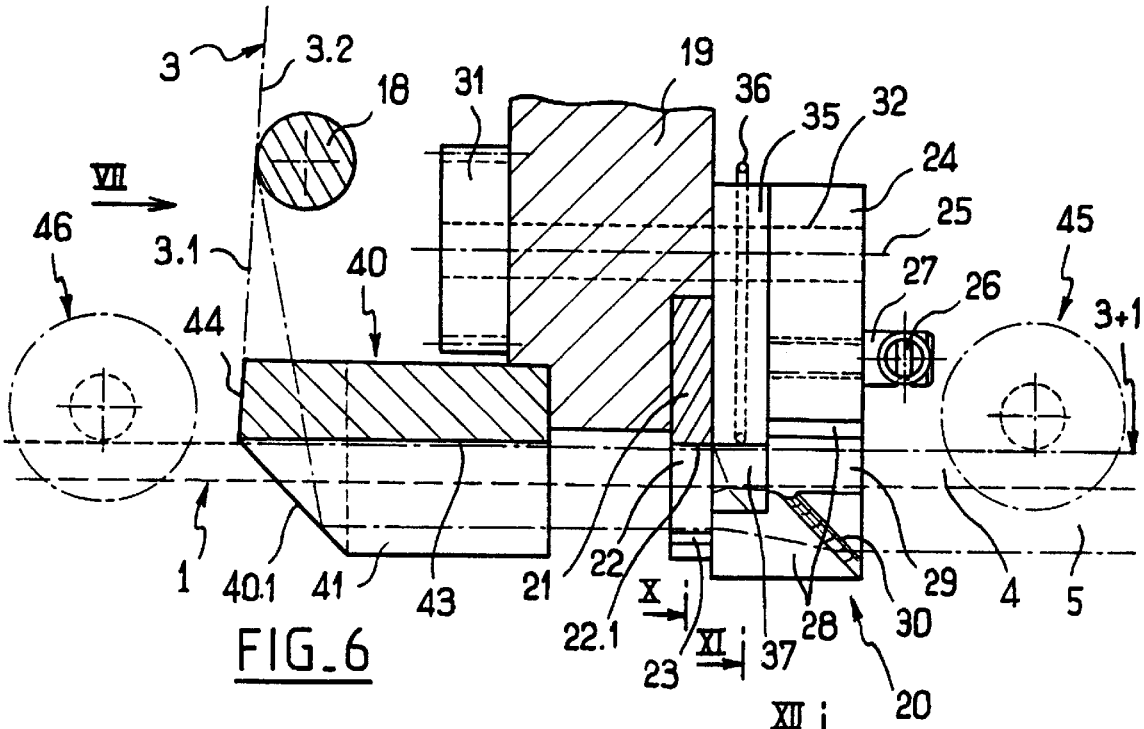
FIG. 6 is a cross-sectional detail along line VI—VI of FIG. 7.
Figure 10A:
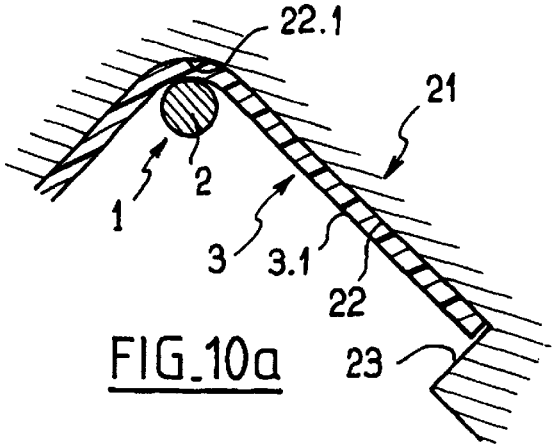
Figure 10B:
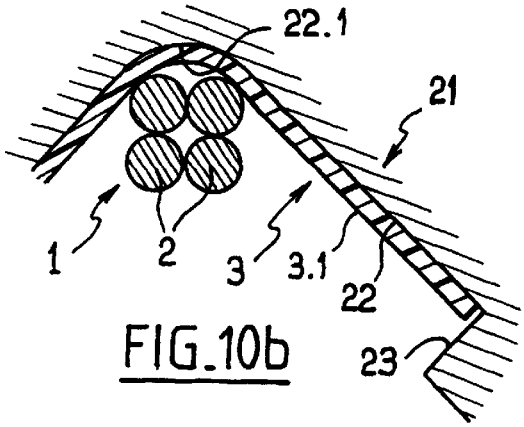
Figure 11A:
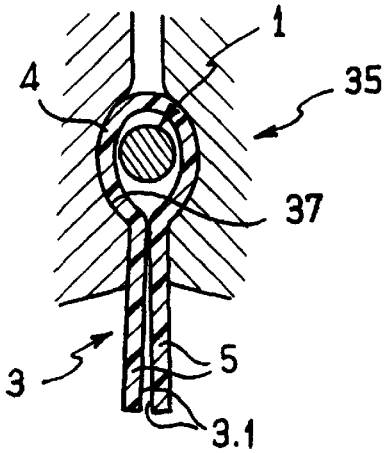
Figure 11B:
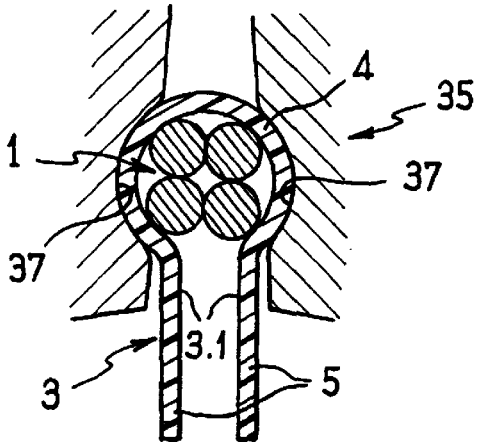
Figure 12A:
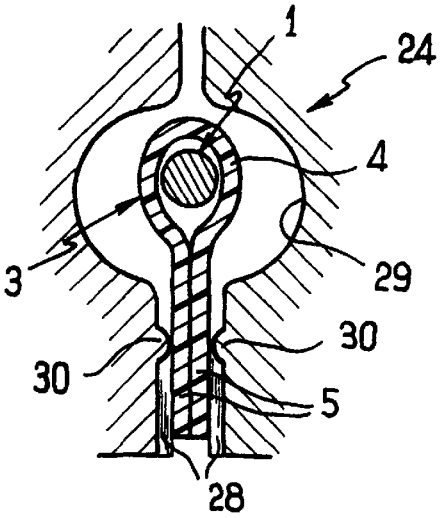
Figure 12B:
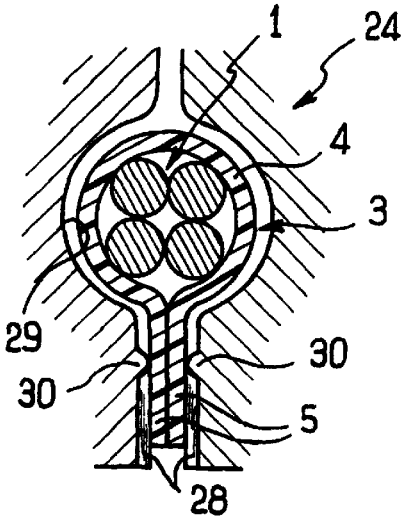
Figure 14:
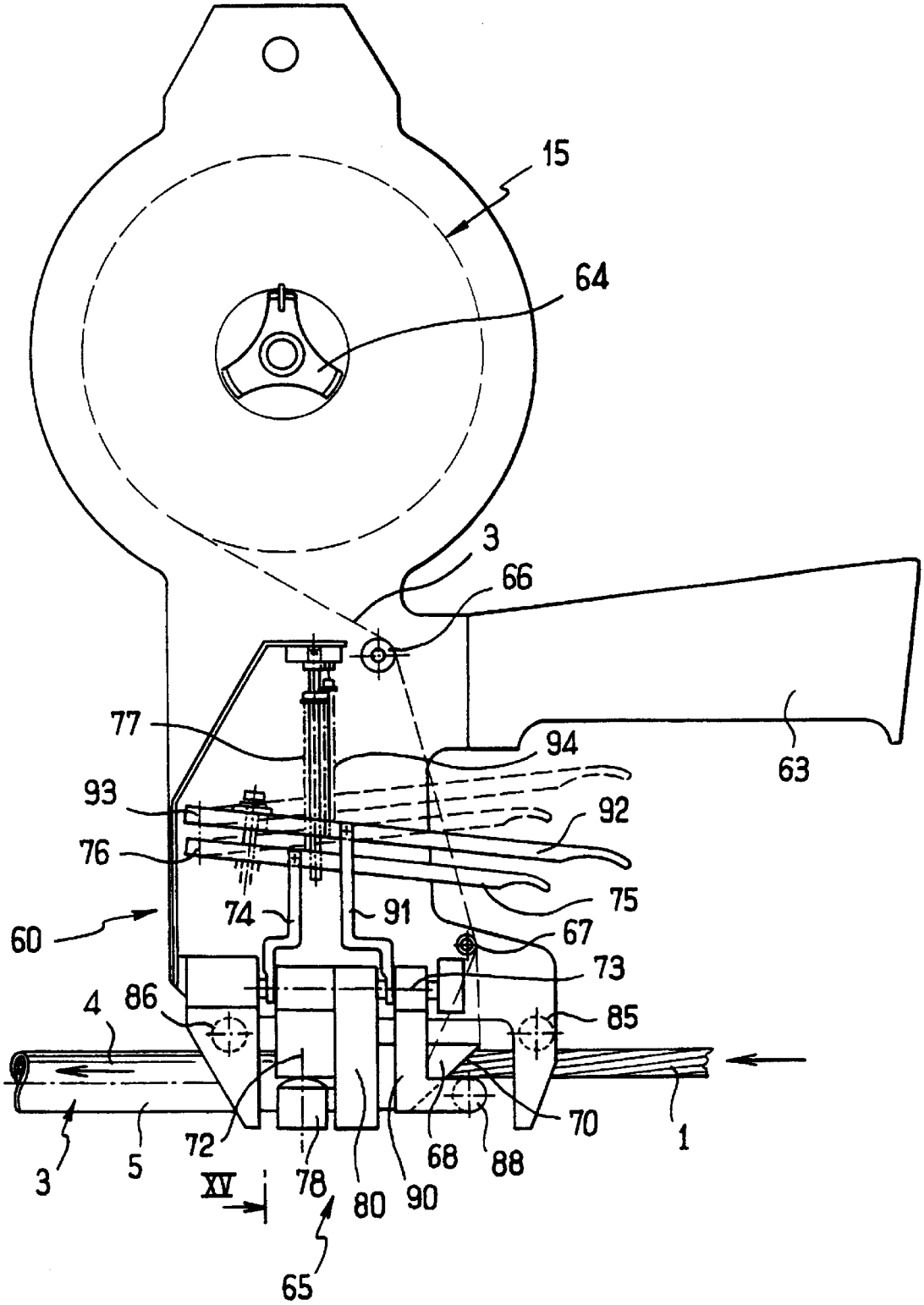
Figure 15:
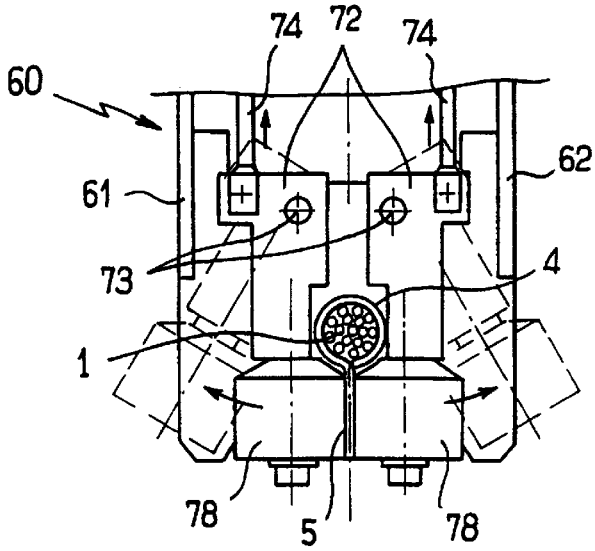
Figure 16:
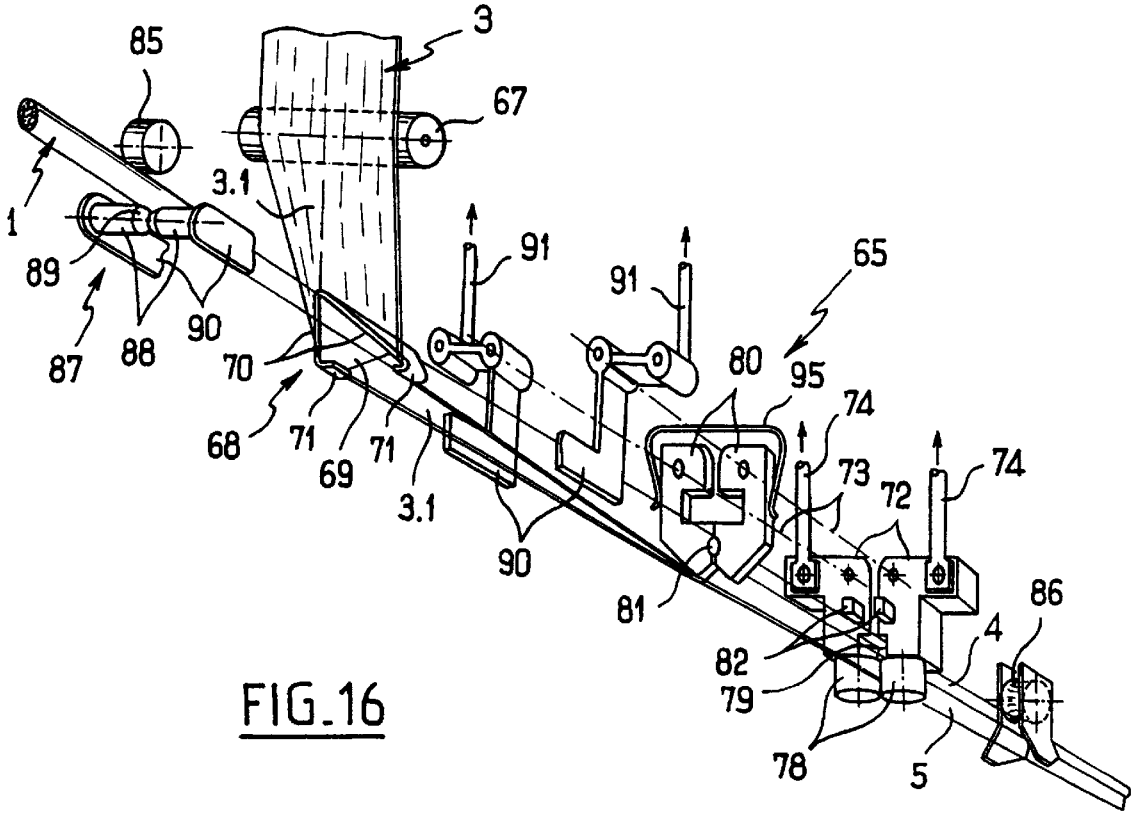

FIGS. 10*a*, 11*a*, 12*a* are partial cross-sectional views, along the arrows X, XI, and XII, respectively, of FIG. 6, illustrating the sheathing of a bundle with small diameter comprising a single wire;

FIGS. 10*b*, 11*b*, 12*b* are analogous views with respect to FIGS. 10*a*, 11*a*, 12*a*, illustrating the sheathing of a bundle with larger diameter comprising four wires;

FIG. 13 is a profile view providing a schematic illustration of an embodiment with fixed position of the sheathing tool of FIGS. 2–12;

FIG. 14 is a profile view of a sheathing tool according to the invention, according to a second embodiment;

FIG. 15 is a partial view according to the arrow XV of FIG. 14;

FIG. 16 is a partial perspective view which schematically illustrates the functions of the different constituent devices of the enveloping head of the tool of FIG. 14.

Figure 1:
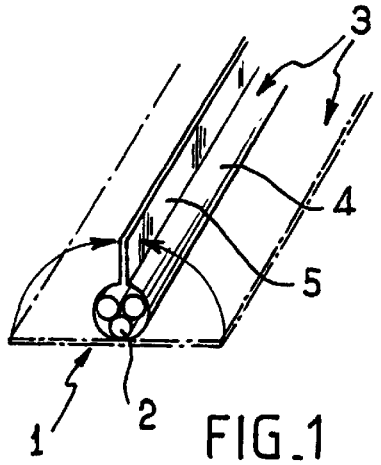
FIG. 1 is a diagrammatic view illustrating the principle of the sheathing of a bundle of wires by a transversely wound ribbon.

FIG. 1 is a diagrammatic illustration of the principle of the sheathing of a bundle 1 of wires 2, such as electrical cables. This sheathing is achieved by means of a ribbon 3 having initially a flat configuration represented in mixed lines. The sheathing is carried out by winding the ribbon 3 transversely with respect to itself around the bundle 1 so as to envelope the latter. The ribbon 3 then presents, longitudinally, a part 4 which is wound around the bundle 1 and forms the sheath, and longitudinal edges 5 which are folded against each other. The ribbon 3 possesses an adhesive face against which the bundle 1 is applied, the longitudinal edges 5 being glued to each other by this adhesive face.

The ribbon 3 can consist of any flexible material, that is, not only of polyurethane foam, baize or a similar material as are usually used for sheathing by manual transverse winding around bundles with moderate and large diameters, but also of any other finer material (PVC, woven fabrics or nonwovens, etc.) which is usually used for the helicoidal sheathing of bundles with small diameters.

FIGS. 2–12 illustrate a first embodiment of the sheathing tool according to the invention. This tool comprises a frame 6 consisting essentially of two flanges 7, 8. This frame is equipped with a principal handle 9 and two secondary handles 10, 11, which allow it to be used either by a left or a right handed person. The handle 9 extends parallel to the flanges 7 and 8, and it is essentially parallel to the bundle 1 to be sheathed, and vertical with respect to the latter, whereas the handles 10, 11 extend along a common axis 13 which is perpendicular to the flanges 7 and 8. A cylindrical support 14 is mounted between the handles 10, 11 of the internal side of the flange 7. This support 14 receives, while rotating, a roller 15, diagrammatically represented with mixed lines, which delivers a flexible adhesive ribbon 3, also diagrammatically shown in mixed lines. This ribbon possesses an adhesive face 3.1 and a nonadhesive face 3.2.

At the bottom of the frame 6, a support block 19 is mounted in a fixed manner between the flanges 7 and 8. This block 19 bears an enveloping head 20 which ensures the enveloping of the bundle 1 by the ribbon 3.

The guiding of the travel path of the ribbon 3 towards the enveloping head 20 is ensured by two guide rollers 17, 18 mounted between the flanges 7 and 8, perpendicular to the latter.

Figure 7:
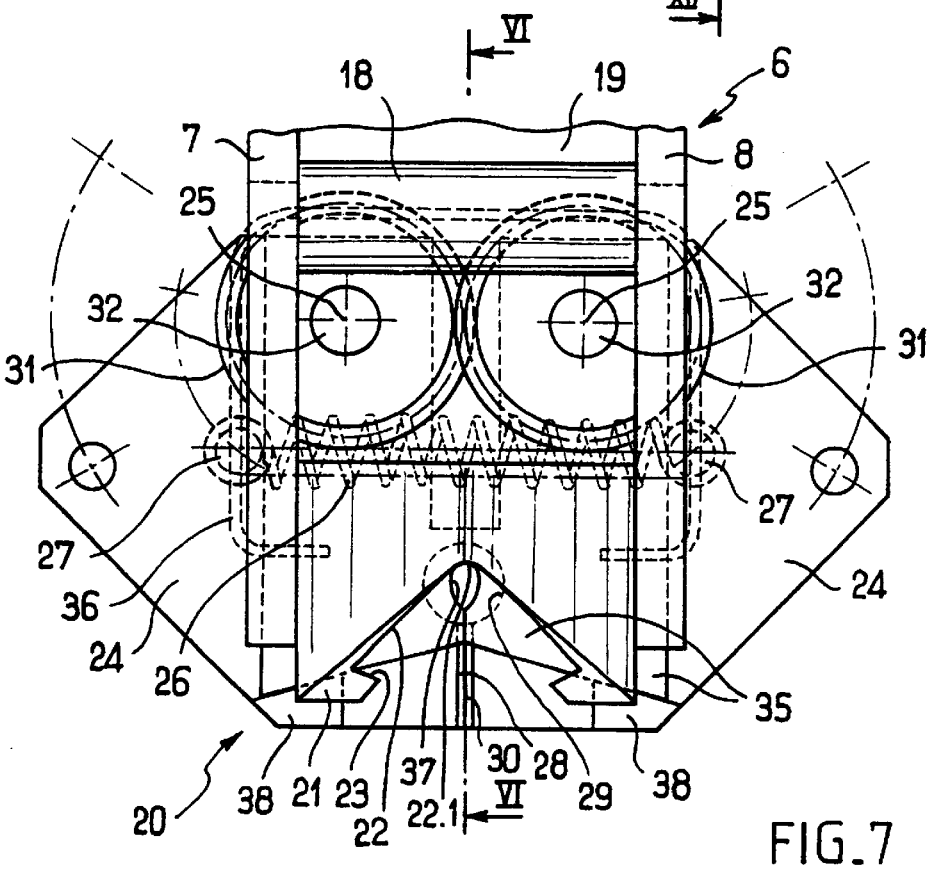
FIG. 7 is a partial front view, along the arrow VII of FIG. 6.

As can be better seen in FIGS. 6–8, this enveloping head 20 comprises two guidance and shaping devices 21 and 40 attached to the block 19 and possessing surfaces 22, 41 with V-shaped profile located one in the extension of the other. These guidance and shaping devices have the main function of starting a transverse folding of the ribbon 3 so as to impart a gutter shape to it.

In this instance, the device 40 is in the form of a block forming a part of a concave dihedron 41 and, on the other hand, a convex dihedron 42 having the respective edges 43, 44 which are perpendicular to each other. The edge 43 of the concave dihedron 41 is essentially parallel to the bundle 1 and it is aligned with the bottom 22.1 of the surface 22 with V profile of the device 21. In the illustrated example, the angles of the dihedra 41 and 42 are essentially equal.

The device 40 also presents, at the intersection of the dihedra 41, 42, a return edge 40.1 in the form of a V which ensures a turning back and longitudinal folding of the ribbon (3), as will be better explained below.

In addition, the surface 22 with V-shaped profile of the device 21 has two end edges 23 which are turned towards each other so as to form support catches for the longitudinal edges 5 of the ribbon 3.

The enveloping head 20 also comprises a first pair of clamping jaws 24 mounted on a block 19 so as to pivot around two axes 25 parallel to the bottom edges 22.1 and 43 of the surfaces 22 and 21 with V-shaped profile. The clamping jaws 24 then pivot in opposite movements between an open position and a closed position towards which they are drawn back by an elastic return device 26. This return device is here implemented in the form of a helicoidal spring which is attached by each one of its two ends to dog points 27 which are integrally connected to the clamping jaws 24. The dog points 27 are arranged in such a manner that, during the opening of the clamping jaws 24, the spring 27 [sic; 26] moves to the other side of the plane defined by the axes 25 so as to pass a "hard point" beyond which this spring 26 keeps the clamping jaws 24 in their open position.

In their closed position, the clamping jaws 24 possess two opposite faces 28 which are applied against each other and define between them a through hole 29 with a diameter which is greater than that of the sheathed bundle and arranged essentially in the extension of the bottom 22.1 of the surface 22 with V-shaped profile of the guidance and shaping device 21. On both sides of the orifice 29, the face 28 presents a flat contact surface. In the illustrated example, the face 28 is provided with an elongated relief 30 which has a rounded section extending along a direction which is appreciably inclined with respect to the axis of the passage orifice 29; that is with respect to the longitudinal direction of the bundle 1.

The clamping jaws 24 are associated with a means for the synchronization of their opposed pivoting. This synchronization means here comprises two toothed wheels 31 which are mounted on the pivoting axes 25 of the clamping jaws 24 so as to engage into each other. One of these wheels is integrally connected so it rotates to one of the clamping jaws 24, whereas the other wheel is integrally connected so it rotates to the other clamping jaw. The integral connection of the wheels 31 and the clamping jaws 24 is ensured through the intermediary of a shaft 32 which extends along the axis 25 and which traverses the block 19, the wheels 31 being arranged on the opposite side of the block 19 with respect to the clamping jaws 24.

The opening of the clamping jaws 24 is controlled by a lever 33 which is mounted on the frame 6 so as to pivot around an axis perpendicular to the flanges 7 and 8, and which is connected by two tie rods 34 to the clamping jaws 24.

The enveloping head 20 also comprises a second pair of clamping jaws 35 mounted on the block 19 between the first pair of clamping jaws 24 and the device 21. These clamping jaws 35 can pivot around the axis 25 in antagonistic movements between an open position and a closed position towards which they are pulled by an associated elastic return device 3.6, here made in the form of a U-shaped curved spring rod. In their closed position, the clamping jaws 35 define between themselves an orifice 37 forming a prewinding die of the ribbon 3 on the bundle 1. This orifice is located essentially in the extension of the bottom 22.1 of the surface 22 with V-shaped profile of the guidance and shaping device 21. In the illustrated example, the die 37 is tapered at its axial end close to the guidance and shaping device 21, as can be seen in FIG. 6; it has the general shape of a funnel.

The opening of the second pair of clamping jaws 35 is controlled by the opening of the first pair of clamping jaws 24. In this instance, each one of the clamping jaws 24 is equipped with a stop device 38 which projects from below the clamping jaws 35 to pull the clamping jaws 24 toward their open position in a rotating movement during the pivoting.

Figure 2:
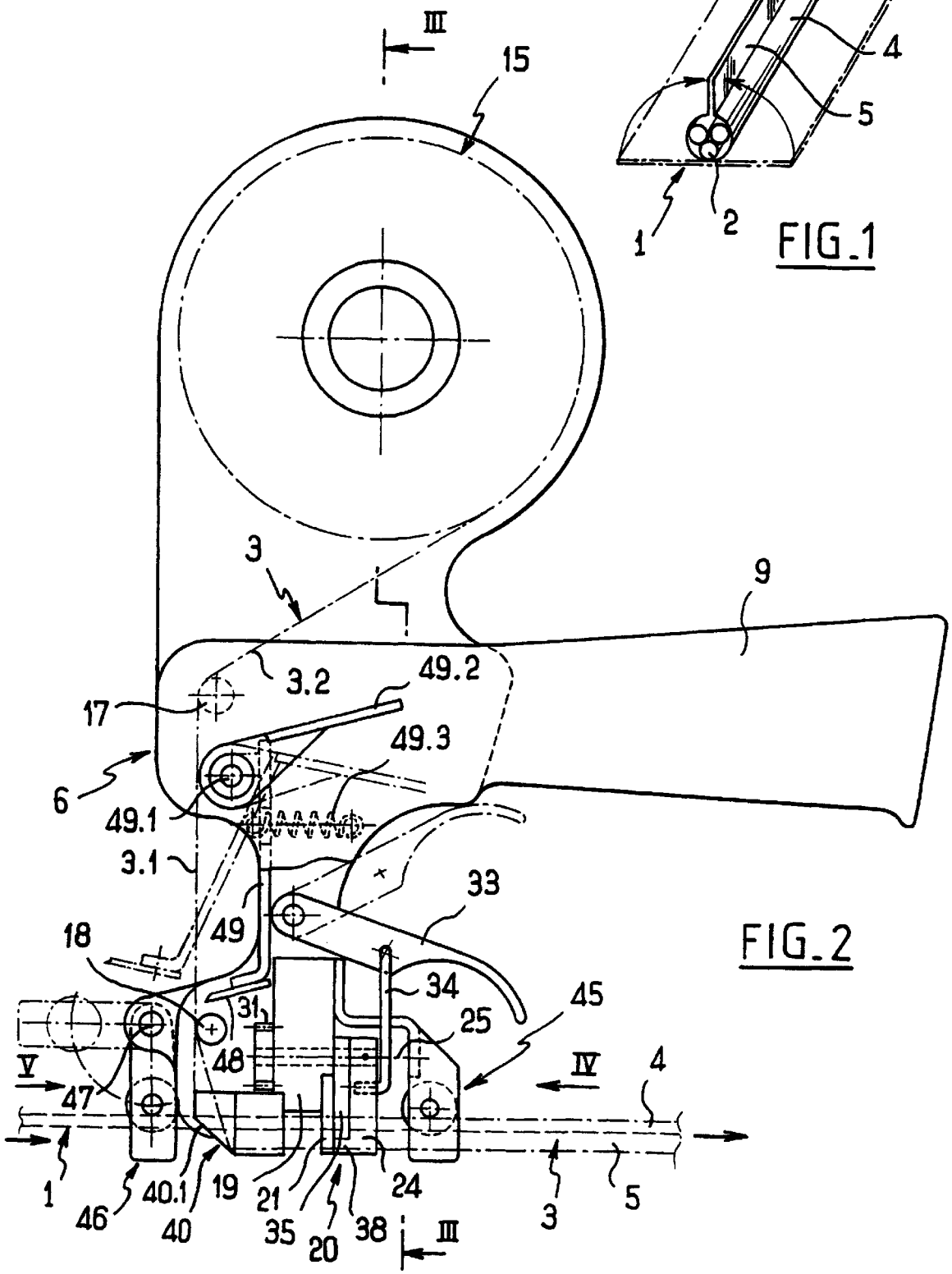
FIG. 2 is a profile view of a sheathing tool according to the invention, according to a first embodiment.
Figure 3:
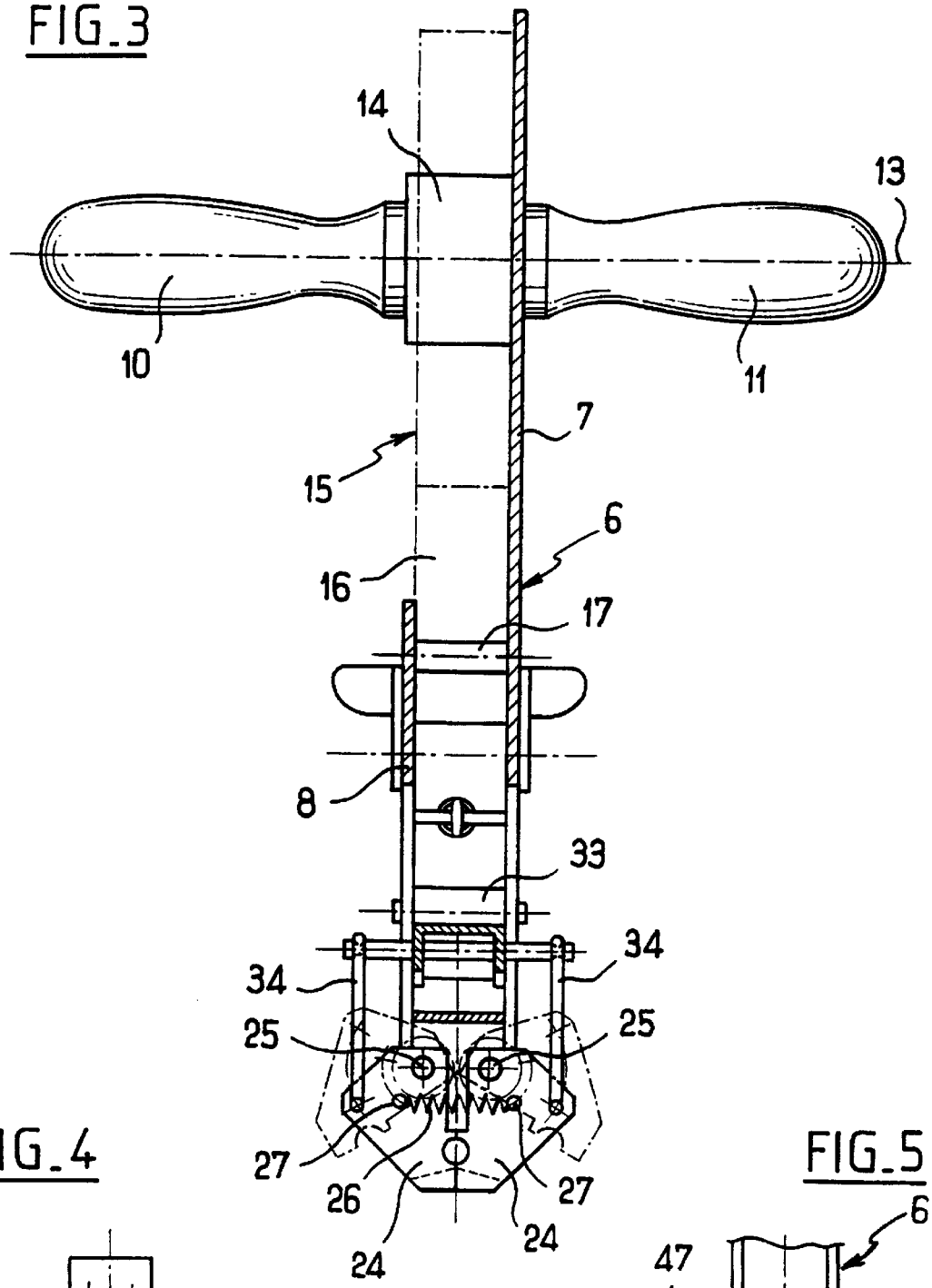
FIG. 3 is a cross-sectional view along line III—III of FIG. 2.
Figure 4:
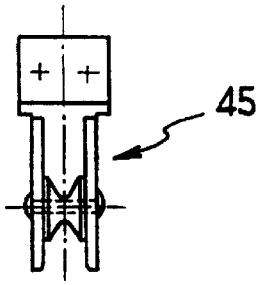
FIG. 4 is a partial view along the arrow IV of FIG. 2.
Figure 5:
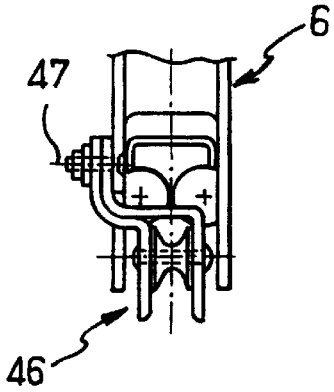
FIG. 5 is a partial view along the arrow V of FIG. 2.

The tool is also equipped with alignment devices, here in the form of two grooved pulleys 45, 46 arranged on both sides of the enveloping head 20 to work in cooperation with the bundle 1. These pulleys ensure the relative alignment of this bundle with the orifices 29 and 37 of the first and second pair of clamping jaws 24, 35 and with the bottom 22.1 of the device 21 and the edge 43 of the return device 40. The details of the implementation of these pulleys 45, 46 is represented in FIG. 2 and in FIGS. 4 and 5. It can be seen that the pulley 45 is mounted in a fixed manner to the frame 6, whereas the pulley 46 is mounted on the frame 6 so as to pivot about an axis 47 perpendicular to the flanges 7, 8. The pulley 46 can thus be lifted so as to facilitate the placement of the ribbon 3 on the enveloping head 20.

The sheathing of the bundle 1 with the tool according to the invention which has just been described-occurs as follows. First the roller 15 is placed on the support 14, and then the ribbon 3 is engaged on the guide 17, 18, the return device 40 and the enveloping head 20. The ribbon 3 matches the shape of the-convex dihedron 42 of the return device 40, its adhesive face 3.1 then also forming a convex dihedron. Downstream from the dihedron 42, the ribbon 3 is applied against the concave dihedron 41, so that the adhesive face 3.1 of the ribbon 3 forms a concave dihedron. The form of the ribbon 3 is that of a profiled part with V-shaped section. The guidance and shaping device 21 guides and maintains the ribbon 3 in its profiled shape. The role played by the end edges 23, 22 should be noted here, it is to ensure the maintenance of the free end of the ribbon 3 against the surface 22, that is in the waiting position.

The two pairs of clamping jaws 24 and 35 are open and the ribbon 3 is introduced into the space delimited by them. The bundle 1 is applied in the bottom of the profiled part formed by the ribbon 3 and the clamping jaws 24 and 35 are closed by lifting the lever 33, under the effect of the elastic return devices 26 and 36. The bundle and the sheathing part 4 which surrounds it are received in the orifices 29 and 37.

The alignment pulleys 45, 46 are engaged on the bundle 1, and the tool is caused to move along this bundle. The ribbon 3 is delivered by the roller 15 and it is progressively closed on the bundle 1 by the return device 40 and the enveloping head 20.

The guidance and shaping device 21 ensures a start of the folding of the ribbon 3 as well as its centering with respect to the bundle 1.

The second pair of clamping jaws 35 ensures the winding and the gluing of the central part of the sheathing 4 of the ribbon 3 on the bundle 1, as well as a start of the closing of the lateral edges 5 of this ribbon. The elastic return device 36 of the clamping jaws 35 ensures a correct placement of the ribbon on the bundle, regardless of the diameter of this bundle. To illustrate the possibilities of variation of the diameter of the bundle 1 permitted by the tool according to the invention, FIGS. 10*a*, 11*a*, 12*a* represent cross-sectional views corresponding to the different constituent devices of the enveloping head for a bundle of small diameter comprising a single wire. Whereas in FIGS. 10*b*, 11*b*, 12*b*, the same views are represented for a bundle with larger diameter comprising four wires. In particular, one can see in FIGS. 11*a* and 11*b*, that the variable opening of the second pair of clamping jaws with elastic return makes it possible to tolerate large variations in diameter without harming the quality of the sheathing produced. Naturally, this example is not limiting, and the bundle can comprise more than four wires.

Downstream from the clamping jaws 35, the clamping jaws 24 ensure the complete closing and the gluing of the lateral edges 5 of the ribbon 3. The linear reliefs 30 provided on the opposite faces 28 of the clamping jaws 24 ensure a regular gluing of maximum quality by expelling as the ribbon advances the air contained in the lateral edges of this ribbon. The orifice 29 defined by the clamping jaws 24 has a slightly larger diameter than the diameter of the sheathed bundle 1, so that this orifice is not resting against the sheathed bundle and does not prevent the closing of the clamping jaws so that the reliefs 30 of the faces 28 apply an application pressure to the lateral edges 5 of the ribbon 3, applying them one against the other.

As can be seen in FIG. 2, the tool is equipped with a blade 48 mounted on a support arm 49 which itself is mounted so it can rotate on the frame 6 to pivot around an axis 49.1 perpendicular to the flanges 7, 8 and integrally connected to an operating handle 49.2. The support arm 49 can pivot between a pulled-in position between the flanges 7, 8, and a pulled-out position represented by mixed lines, in which the blade 48 extends beyond the travel path of the ribbon 3, the arm 49 being returned towards its pulled-in position by a spring 49.3. Thus, it is sufficient to actuate the lever 49.2 to cause the arm 49 to pivot in the direction of the ribbon 3 so as to cut the latter with the blade 48. This cutting function is used as the end of the sheathing.

FIG. 13 represents an embodiment of the above-described tool. This tool differs from the one described above only by the fact that the handles, which earlier bore the reference numerals 9, 10 and 11, have been eliminated, the handle 9 having been replaced by a vice 50 for its attachment to a table 51. The sheathing tool is then fixed, and the bundle 1 is advanced on the enveloping head 20 and the alignment pulleys 46.

It is then possible to automate the advance of the bundle 1 by equipping the tool with motorized rollers replacing or complementing the alignment pulleys 45, 46.

FIGS. 14–16 represent a sheathing tool according to a second embodiment of the invention. This tool comprises, as in the first embodiment, a frame 60 formed of two flanges 61, 62 and equipped with a handle 63 parallel to the bundle to be sheathed accommodated in the enveloping head and extending beyond it, and a support 64 for the roller 15 of adhesive ribbon 3 described above. This tool is provided to be pulled on the bundle, in contrast to the first embodiment, where it is pushed on the bundle.

At the bottom part of the frame 60, the tool comprises an enveloping head 65 which ensures the placement and the closing of the ribbon 3 on the bundle 1.

The enveloping head 65 here comprises a guidance and shaping device 68 for the ribbon 3, integrally connected to the frame 60. This device is here made of a single part with a V-shaped profile. It has an internal surface 69 with a V profile and a return edge 70 in the shape of a V, located in a plane whose perpendicular is slanted (by approximately 45°) with respect to the longitudinal direction of the bundle 1. The edge 70 thus presents a configuration similar to that of the edge 40.1 of the first embodiment and it ensures, as the latter did, the bending and the longitudinal folding of the ribbon 3 so as to impart a gutter shape to it.

The guidance and shaping device 68 possess in addition two lateral end edges 71 which are turned toward each other so as to form catches for holding the longitudinal edges of the ribbon 3.

The enveloping head 65 also comprises a first pair of clamping jaws 72 mounted on the frame 60 to pivot around two axes 73 parallel to the bottom edge of the surface 69 with a V profile. The clamping jaws 72 pivot in antagonistic movements between an open position and a closed position. The pivoting of the clamping jaws 72 is controlled by two tie rods 74 connected to a lever 75 mounted on the frame 60 to allow pivoting around an axis 76 perpendicular to the flanges 61, 62 of the frame 60. This lever 75 is pulled back by a compression spring 77 in the closed position of the clamping jaws 72.

The clamping jaws 72 possess two rollers 78 which are mounted so they can freely rotate to form, in the closed position, drums which ensure the application and the gluing of the longitudinal edges 5 of the ribbon 3, as can be better seen in FIG. 15.

In a closed position, the clamping jaws 72 delimit between themselves a passage orifice 79 whose transverse dimensions are greater than the diameter of the sheathed bundle. This passage orifice is adjacent to the rollers 78 and it is arranged approximately in the extension of the bottom edge of the surface 69 with a V profile of the guidance and shaping device 68.

The enveloping head 65 also comprises a second pair of clamping jaws 80 mounted on the frame 60 between the first part of clamping jaws 72 and the guidance and shaping device 68. These clamping jaws 80 can pivot around axes 73 in antagonistic movements between an open position and a closed position towards which they are drawn back by an associated elastic return device 95. In their closed position, the clamping jaws 80 define between themselves an orifice 81 which forms a prewinding die for the ribbon 3 on the bundle 1.

The opening of the second pair of clamping jaws 80 is controlled by the opening of the first part of clamping jaws 72. Each one of the clamping jaws 72 is in fact equipped with a drive pin 82 which projects between the clamping jaws 80 to pull them along during the pivoting of the clamping jaws 72 towards their open position.

As before, the tool is equipped with alignment devices implemented in the form of grooved pulleys 85, 86, arranged on both sides of the enveloping head 65 to work in cooperation with the bundle 1, respectively upstream and downstream of the enveloping head 65 with reference to the direction of advance of the bundle 1. These pulleys ensure the relative alignment of the bundle 1 with the orifices 79 and 81 of the first and second pairs of clamping jaws 72 and 80 and with the bottom of the surface with V-shaped profile 69 of the device 68.

In addition, the tool comprises an additional guide 87 consisting of two half-rollers 88 which form between themselves a groove 89 intended to receive the bundle 1. The two half-rollers 88 are supported by two arms 90 mounted on a frame 60 so as to pivot between a closed position in which the two half-rollers 88 are in contact and form the guidance groove 89 for the bundle 1 and an open position in which the two half-rollers 88 are separated from each other to allow the passage of the bundle 1. In this instance, the clamping jaws 90 pivot around the axes 73. Their opening and their closing are controlled by two tie rods 91 which are attached to a common lever 92 which is mounted on the frame 60 so as to pivot around an axis 93 perpendicular to the flanges 61, 62 of this frame. The lever 92 is drawn back into the closed position of the clamping jaws 90 by compression spring 94. The opening of the additional guide 87 can thus be controlled by the lever 92 independently of the clamping jaws 72 and 80. This functionality is particularly useful for overcoming deviations of bundles, because it makes possible to clear the deviation without opening the clamping jaws 72 and 80 of the enveloping head, that is without interrupting the sheathing.

I claim:

1. Tool for sheathing a bundle (1) of wires (2) by enveloping this bundle in a flexible adhesive ribbon (3) which is wound transversely with respect to itself around the bundle (1) and whose longitudinal edges (5) are joined by gluing, characterized in that the tool comprises a frame (6; 60) equipped with an enveloping head (20; 65) comprising a shaping device (40, 21; 68) for the ribbon (3), which is mounted in a fixed manner to the frame (6; 60) and which possesses a return edge (40.1, 70) in the shape of a V arranged to prepare a longitudinal fold of ribbon (3) and at least a first pair of clamping jaws (24; 72) mounted on the frame (6; 60), which are movable between an open position and a closed position in which they are applied one against the other by return means (26; 77) to ensure the gluing of the longitudinal edges (5) of the ribbon (3) one against the other and define between themselves a passage orifice (29; 79) for the sheathed bundle (1).

2. Tool according to claim 1, characterized in that the enveloping head (20; 65) comprises a second pair of clamping jaws (35; 80) mounted on the frame (6; 60) between the first pair of clamping jaws (24; 72) and a shaping device (40; 21; 68) which are movable between an open position and a closed position towards which they are drawn back by return means (36; 95) and in which they define between themselves a prewinding die (37; 81) for the ribbon (3) around the bundle (1).

3. Tool according to claim 1, characterized in that the tool comprises at least an alignment guide (46; 85) for the bundles (1), arranged on the frame (6; 60) upstream from the enveloping head (20; 65) with reference to a direction of advance of the bundle (1), to align the bundle (1) with the passage orifice (29; 79) of the first pair of clamping jaws (24; 72) and the tip of the return edge (40.1; 70) in the shape of a V of the shaping device.

4. Tool according to claim 3, characterized in that the tool comprises a second guide (45; 86) for the alignment of the bundle (1) arranged upstream from the enveloping head (20; 65).

5. Tool according to claim 4, characterized in that the two alignment guides of the bundle consist of two pulleys (45, 46; 85, 86) arranged on both sides of the enveloping head (20; 65).

6. Tool according to claim 4, characterized in that the tool comprises an additional guide located upstream from the enveloping head (65) of a side of the bundle (1) opposite the corresponding alignment guide (85), this additional guide comprising two parts (88) mounted on the frame (60) so as to be mobile with respect to each other, between a closed position in which they are in contact and an open position in which they are separated from each other to allow the passage of the bundle.

7. Tool according to claim 1, characterized in that the shaping device (21; 68) possesses two end edges (23; 71) forming support catches for the longitudinal edges (5) of the ribbon (3).

8. Tool according to claim 2, characterized in that the two pairs of clamping jaws (24, 35; 72, 80) are mounted on the frame (6; 60) so as to pivot around the two axes (25; 73) parallel to each other, one of these two axes being shared by one of the clamping jaws of each pair and the other axis being shared by the other clamping jaw of each pair.

9. Tool according to claim 8, characterized in that each one of the clamping jaws (24; 72) of the first pair of clamping jaws is equipped with a stop device (38; 82) which works in cooperation with the associated clamping jaw (35; 80) of the second pair of clamping jaws to pull it along in its pivoting towards the open position.

10. Tool according to claim 1, characterized in that the clamping jaws (72) of the first pair possess two rollers (78) revolving around two parallel axes to form drums for the application of the longitudinal edges (5) of the ribbon (3).

11. Tool according to claim 1, characterized in that the frame (6; 60), equipped at the bottom part with the enveloping head constitutes above this enveloping head a support (14; 64) for a ribbon roller (15) and for at least one handle (9, 63) for operating the tool extending essentially in parallel to the path of the bundle in the enveloping head.

* * * * *